United States Patent [19]

Smith

[11] Patent Number: 4,802,590

[45] Date of Patent: Feb. 7, 1989

[54] MILK CARTON WITH FOLDED SPOUT

[76] Inventor: Barry W. Smith, 535 Plum Ave., Sutherlin, Oreg. 97479

[21] Appl. No.: 112,405

[22] Filed: Oct. 26, 1987

[51] Int. Cl.[4] ..... B65D 5/70

[52] U.S. Cl. ..... 206/620; 206/621.5; 206/621.6; 206/626

[58] Field of Search ..... 229/125.42, 123.2; 206/621.3, 621.5, 621.6, 631.1, 631.2, 620, 626, 621

[56] References Cited

U.S. PATENT DOCUMENTS

| | | | |
|---|---|---|---|
| 1,092,148 | 4/1914 | Jones | 229/123.2 |
| 1,203,924 | 11/1916 | Snyder | 206/621.5 |
| 1,975,963 | 10/1934 | Marsh | 229/123.2 |
| 2,313,987 | 3/1943 | Buttery | 206/621.5 |
| 2,345,978 | 4/1944 | Hultin | 206/621.5 |
| 2,349,362 | 5/1944 | Marshall | 206/621.5 |
| 2,417,498 | 3/1947 | Hultin | 206/621.5 |
| 2,523,668 | 9/1950 | Read | 229/125.42 |
| 3,037,679 | 6/1962 | Metzger | 206/621.5 |
| 3,107,038 | 10/1963 | Kuchenbecker | 206/621.5 |
| 3,117,710 | 1/1964 | Beach, Jr. | 206/621.3 |

FOREIGN PATENT DOCUMENTS

| | | | |
|---|---|---|---|
| 1248546 | 11/1960 | France | 206/621.3 |
| 90790 | 2/1968 | France | 229/125.42 |
| 618932 | 8/1980 | Switzerland | 206/621 |
| 342137 | 1/1931 | United Kingdom | 206/621.3 |
| 615161 | 1/1949 | United Kingdom | 206/621.3 |

*Primary Examiner*—Stephen Marcus
*Assistant Examiner*—Gary E. Elkins
*Attorney, Agent, or Firm*—James D. Givnan, Jr.

[57] ABSTRACT

A milk container having a spout formed so as to be collapsible into parallel with a flat top wall of the container. A fold line of the collapsed spout is disposed for upward displacement by a fingertip whereafter the spout may be grasped and pulled by the user's fingertips to an open position. A preferred embodiment of the spout is located at a top wall corner of the container. A modified spout structure is located along an edge of the container top wall.

2 Claims, 1 Drawing Sheet

MILK CARTON WITH FOLDED SPOUT

BACKGROUND OF THE INVENTION

The present invention pertains generally to folded cartons of the type used as milk containers and particularly to spout construction therefor.

Milk cartons are typically of cellulosic fibrous material cut and shaped so as to provide a container that is openable by fingertip pressure. A drawback to known carton construction is that the top wall thereof is inclined or peaked resulting in the area for stacking of a quantity of cartons being greater than if the cartons each had a planar top wall. Further, the amount of material required for a carton with a top wall of peak configuration is greater than for a carton having a top wall of flat configuration.

SUMMARY OF THE PRESENT INVENTION

The present invention is embodied in milk carton construction wherein a top wall structure has a spout which, when folded, lies substantially coplanar with remaining top wall structure.

The present carton structure provides a folded spout which may be located proximate a carton corner or along an edge of the carton top wall. A fold of the spout suggests to the user the manner in which the spout is deployed. A portion of the spout is detached from the carton top wall during opening of the carton.

Important objectives of the present carton spout structure include the provision of carton top wall and spout structure which permits said top wall to be flat for economy of storage space; the provision of carton structure particularly suited wherein a spout is provided that readily suggests the manner of spout deployment particularly to young children to whom half pint milk containers are distributed; the provision of milk carton structure which effects a savings in carton material per container.

DETAILED DESCRIPTION OF THE PREFERRED EMBODIMENTS

Figure 1:
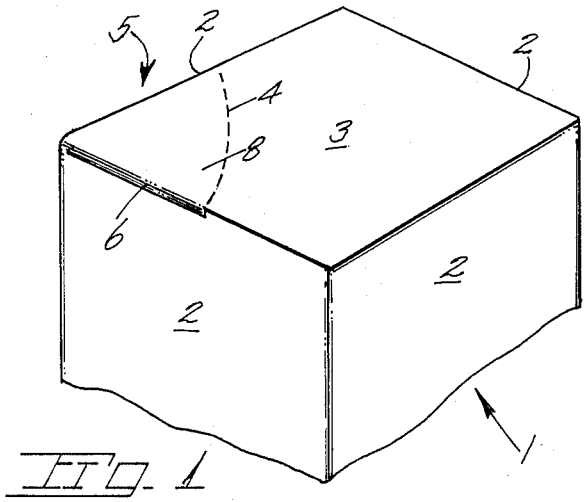
FIG. 1 is a perspective view of a carton fragment with the spout structure coplanar with a carton top wall.

With continuing attention to the drawings wherein applied reference numerals indicate parts similarly hereinafter identified, the reference numeral 1 indicates generally a liquid container such as a milk carton having contiguous upright walls 2 and a top wall 3.

Typically small containers for liquids are formed from paper blanks by automatic equipment with which the present carton construction is believed to be compatible. The present description pertains to a portion of carton top wall construction. The remaining carton structure may be of the type presently in use.

Top wall 3 includes an expanse of carton material having a line of severance at 4 such as a line of partial perforations which define a spout generally at 5. A primary spout fold is at 6 which is the juncture of primary spout members at 8 and 9.

Secondary spout members 10 and 11 are integral with primary spout members 8 and 9. The secondary spout members 10 and 11 each terminate in an intersection 12–13 with upright carton walls 2.

Figure 2:
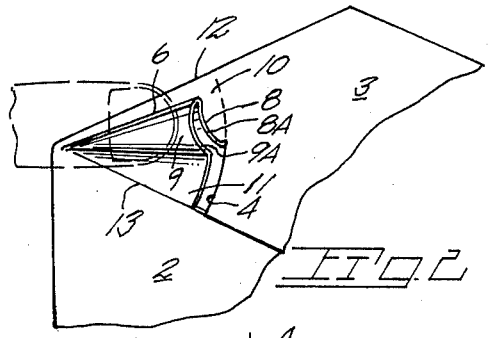
FIG. 2 is a view similar to FIG. 1 but with the spout partially deployed.
Figure 3:
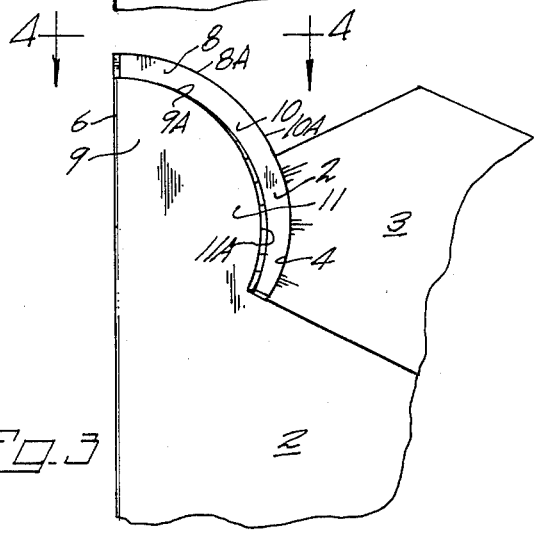
FIG. 3 is a view similar to FIG. 1 with the spout fully deployed.
Figure 4:
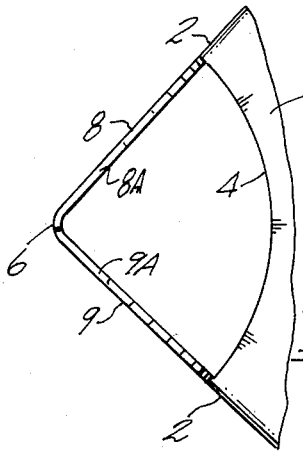
FIG. 4 is a view taken downwardly along line 4—4 of FIG. 3.

With reference to FIGS. 2 and 3, primary spout members have edges 8A and 9A while secondary spout members have edges 10A and 11A. Spout edge 11A is horizontally offset somewhat from the line of perforations at 4 when the spout is in the stowed position.

Spout deployment entails initially the insertion of a fingernail edge below fold 6 with lifting of the fold causing a separation along line 4. Completed separation entails pinching by the fingertips of the raised primary spout members 8 and 9 enabling the spout to be pulled upright to the position of FIG. 3.

Figure 5:
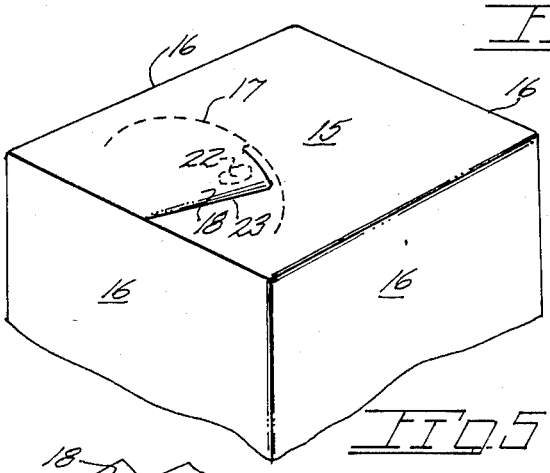
FIG. 5 is a perspective view of a carton having a modified spout structure.
Figure 6:
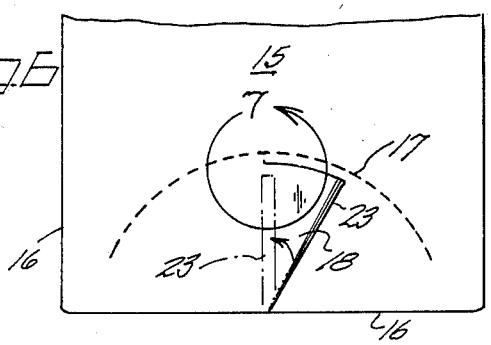
FIG. 6 is a plan view of FIG. 3 with a fragment of the carton broken away.
Figure 7:
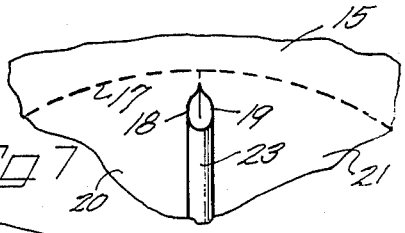
FIG. 7 is an enlarged fragmentary view of that portion of FIG. 6 encircled at 7 and with the spout partially deployed.
Figure 8:
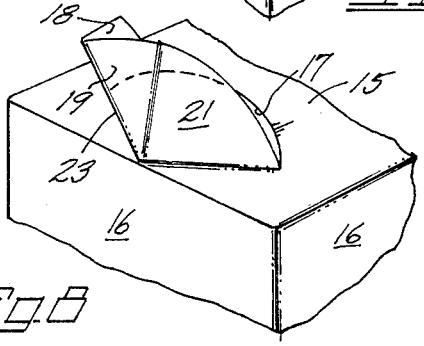
FIG. 8 is a view similar to FIG. 5 but with the spout fully opened.
Figure 9:
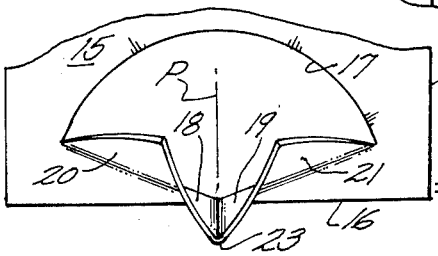
FIG. 9 is a top plan view of FIG. 8.

The modified carton construction of FIG. 5 provides a spout located along a side edge of a carton top wall 15. Side walls of the modified carton are at 16. Top 15 has an arc line of separation 17 along which partial perforations permit spout separation during deployment. A spout comprises primary members 18 and 19 while secondary members are at 20 and 21. Superimposed primary members 18 and 19 of the spout are held in place by a spot of adhesive at 22 or are otherwise secured to a secondary member 20 or 21 so as to normally overlie same. A fold line at 23 joining the primary members of the spout suggests primary members deployment initially by a fingertip with the raised spout thereafter being grasped by the fingers. Such lifting causes, in sequence, the separation of spout secondary members 20 and 21 and thence primary members 18 and 19 to the deployed position of FIGS. 8 and 9. Fold line 23 of the spout is in a plane P perpendicular to a carton side wall 16.

The manner in which the spout is positionable is believed apparent from the foregoing description of same.

While I have shown but a few embodiments of the invention, it will be apparent to those skilled in the art that the invention may be embodied still otherwise without departing from the spirit and scope of the invention.

Having thus described the invention, what is desired to be secured in a Letters Patent is:

I claim:

1. In a liquid storage carton of fibrous material and having contiguous side walls and a perpendicular top wall, the improvement comprising a spout integral with the top wall of the carton and having a pair of primary members jointed along a fold line, said fold line intersecting a carton edge intermediate extremities of said edge, a pair of secondary members integral with said primary members and with said top wall, said spout when collapsed lying in parallel relationship with the carton top wall, a line of severance extending horizontally in said top wall and terminating in said top wall at points offset from said carton edge, said line of severance denoting the extremities of said secondary members, said primary members folded against one another and overlying one of said secondary members, said primary members of the spout additionally serving as a finger grip during deployment of the spout from the carton top wall with separation of said secondary members from the top wall occurring along said line of severance.

2. The improvement claimed in claim 1 wherein said line of severance is an arc.

* * * * *